US005864902A

United States Patent [19]

Rogers

[11] Patent Number: 5,864,902

[45] Date of Patent: Feb. 2, 1999

[54] FOLDABLE STRETCHER ARM SUPPORT

[76] Inventor: Walter L. Rogers, 8801 Hunters Lake Dr., #1216, Tampa, Fla. 33647

[21] Appl. No.: 607,123

[22] Filed: Feb. 26, 1996

[51] Int. Cl.[6] ..... A47C 20/00

[52] U.S. Cl. ..... 5/623; 5/647; 297/411.23; 297/411.37; 297/411.38

[58] Field of Search ..... 5/623, 647, 650, 5/624, 621, 646; 297/411.23, 411.37, 411.38

[56] References Cited

U.S. PATENT DOCUMENTS

| | | | |
|---|---|---|---|
| 473,200 | 4/1892 | Streeter | 5/623 |
| 541,863 | 7/1895 | Loomis | 5/623 |
| 988,923 | 9/1911 | Bauerfeind | 5/623 |
| 1,516,795 | 11/1924 | Schwarting | 5/623 |
| 2,614,558 | 10/1952 | Lovell | 5/623 |
| 3,046,072 | 7/1962 | Douglas, Jr. et al. | 5/623 |
| 3,614,085 | 10/1971 | Cunningham | 5/623 |
| 3,678,926 | 7/1972 | Strittmatter | 5/647 |
| 5,375,276 | 12/1994 | Nelson et al. | 5/621 |
| 5,485,856 | 1/1996 | Buckland | 5/647 |

*Primary Examiner*—Alexander Grosz
*Attorney, Agent, or Firm*—Dorothy S. Morse; American Innovations, Inc.

[57] ABSTRACT

An adjustable arm support for attachment to a medical stretcher for use in supporting in a fixed position the arm of a person sitting or lying on the stretcher. The arm support would attach to one of the side rails of a stretcher, attach equally well to the left and right sides of the stretcher, and be foldable against the side rail when not needed for use. Also, when the side rail of the stretcher is lowered, the arm support attached to it assumes an out-of-the-way position beneath the stretcher. A swivel unit and locking bolts would allow for adjustment of the height of the arm support, as well as its pitch and yaw movement. In the preferred embodiment hook and pile fasteners would be used to secure a person's arm to the arm support. Also, when the person leaves the stretcher, the arm support could be detached from the stretcher, while continually supporting the person's arm, and moved with the person for subsequent attachment to other objects.

5 Claims, 5 Drawing Sheets

Figure 1
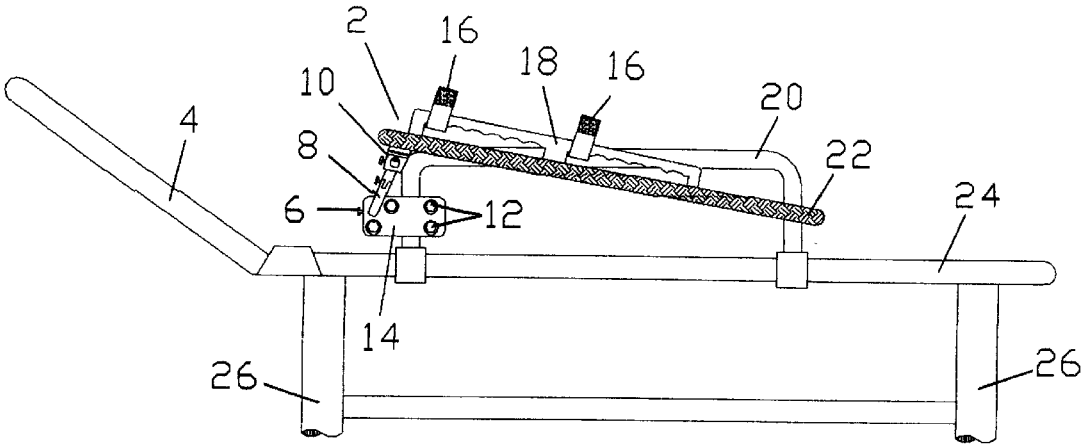
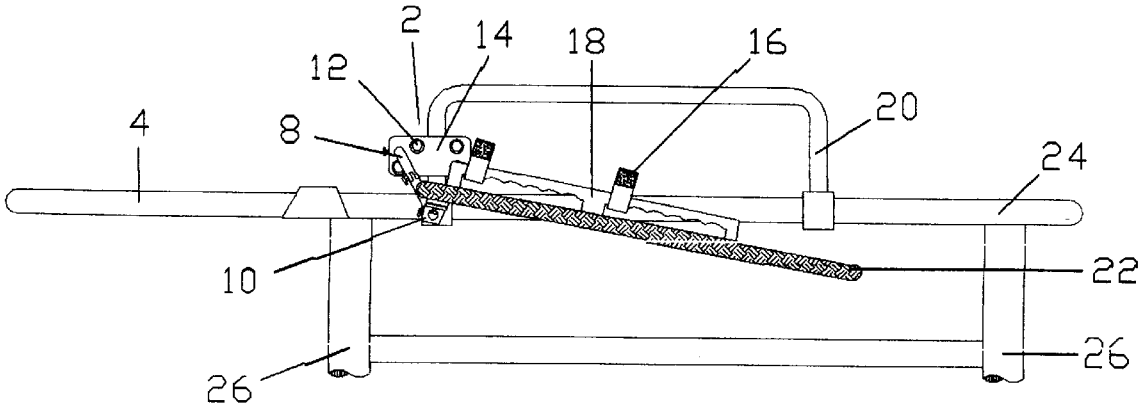
Figure 2

Figure 4
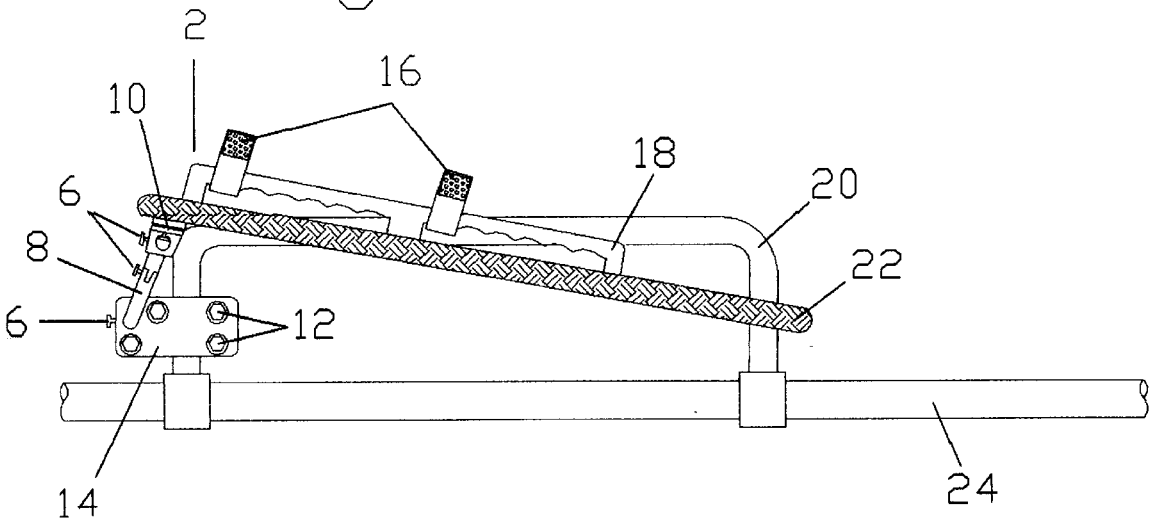
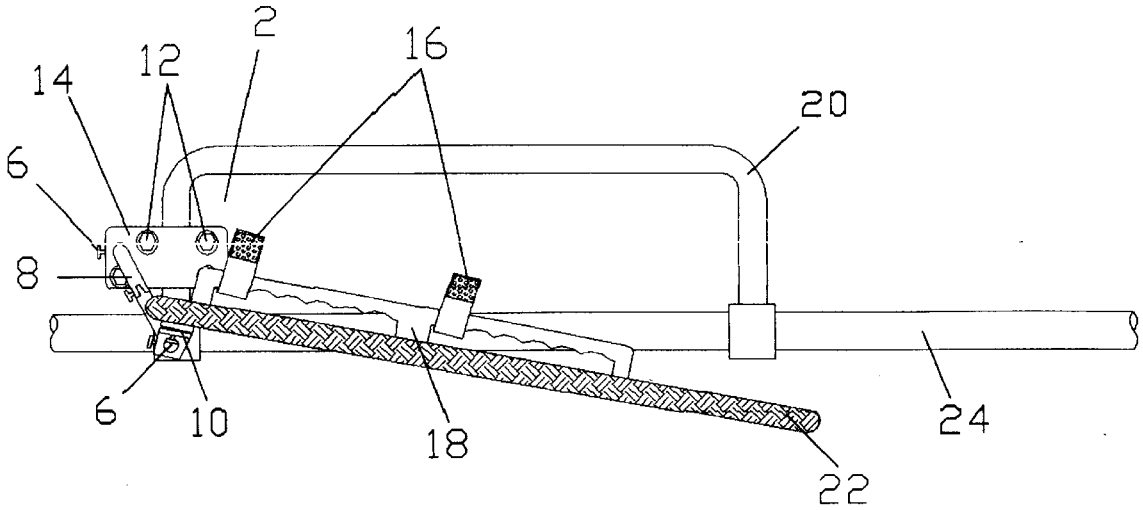
Figure 5

Figure 6
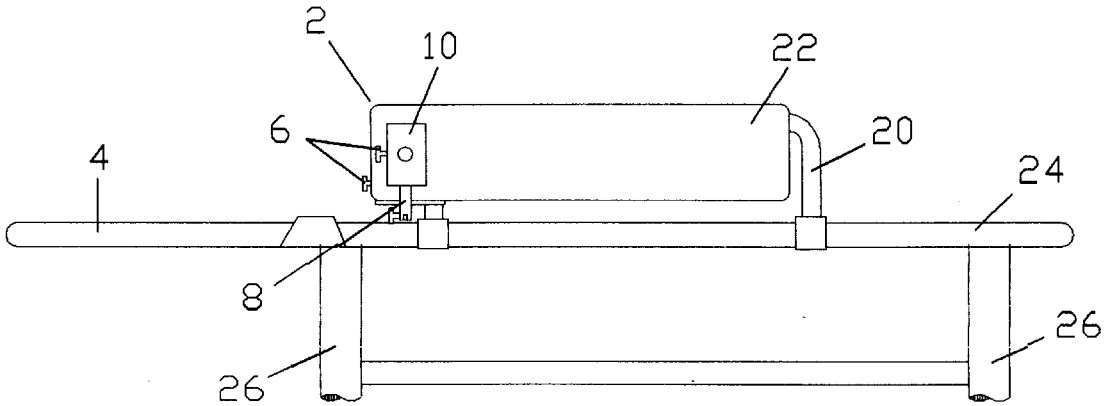
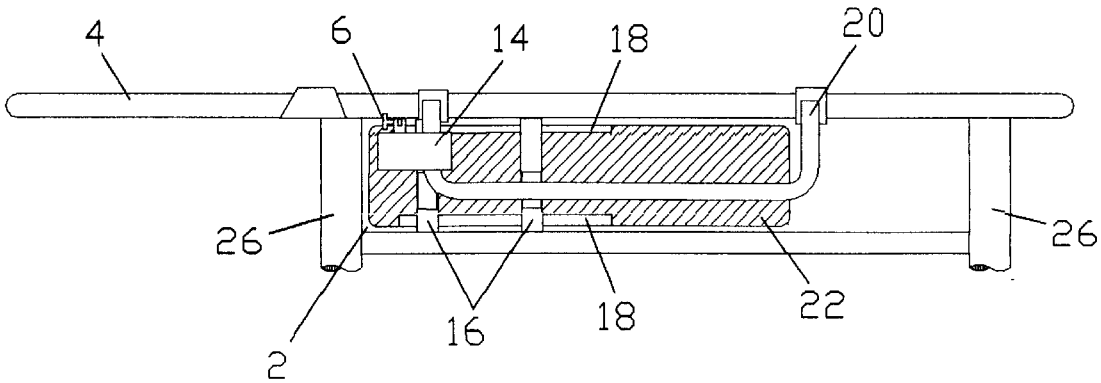
Figure 7

FOLDABLE STRETCHER ARM SUPPORT

BACKGROUND—FIELD OF THE INVENTION

This invention relates to supporting devices, specifically to an adjustable arm support for attachment to a medical stretcher for use in supporting a patient's arm in a fixed position during transport.

BACKGROUND—DESCRIPTION OF PRIOR ART

It is important to rapidly transport a sick or injured person to a medical facility for evaluation and treatment. It is equally important to have the sick or injured person arrive at a medical facility without having his or her injuries aggravated by the transport process and for the emergency medical personnel to arrive uninjured. Ambulances are known to encounter dangers as they attempt to arrive quickly at a medical facility. Ambulances are also known to be forced to pause at each intersection where the traffic signals allow a right-of-way to cross traffic and to stop quickly when others fail to yield the right-of-way. They may also encounter rough roads and be required to drive over medians in the center of divided highways due to obstacles, or heavy traffic volume, to arrive more quickly at their destination. As a result, a person riding in an ambulance will not always get a smooth ride to a medical facility. It is therefore important to keep injured portions of the body immobilized to every extent possible during transport. Also, if an arm is restrained for the purpose of insertion of an intravenous needle, it is less likely to move should the ambulance encounter any of the afore-mentioned hazards. Restraint of the arm will decrease the likelihood of further injury to the patient and possible unnecessary injury or exposure to emergency medical personnel.

People are usually placed on stretchers during a ride in an ambulance to a medical facility. Stretchers are designed to be narrow for efficient positioning within an ambulance and for easy movement in and out of the ambulance. Stretchers also have side rails to keep the injured person from rolling off its sides during transport. The majority of the time, a person's arms are placed in a flat position on the stretcher adjacent to the side rails. However, when the stretcher is used to transport a very large, or obese, person there may not be enough room on the surface of the stretcher for placement of the person's arms. During transport the loose arms may become injured, or injure emergency medical personnel. Further, it is common for the side rails to be lowered when a stretcher is used to transport a very large, or obese, person, leaving no protection at all for that person's arms. Also, when an injured arm is placed between the person's body and a side rail of the stretcher, the arm may be further injured should the person's body move against it during rough transport. Further, an arm may require elevation with respect to the person's body during transport. It is not known to have an adjustable arm support for attachment to a stretcher for use in supporting a patient's arm in a fixed position during transport.

It is known to use boards, splints, and inflatable devices for temporary support of injured arms and legs. Such devices may also be used on a person placed upon a stretcher. However, although arms supported by such devices are immobilized, they are not secured to the stretcher and may move independently from the stretcher during transport. Such movement could further injure the arm or cause the patient pain. The arms of very large or obese people, which could not be placed between their bodies and a side rail, would be particularly vulnerable to such injury and pain. Also such devices may interfere with the insertion of intravenous devices or other emergency treatment. Further, boards, splints, and inflatable devices do not provide stationary elevation for the arm of a person sitting or lying on a stretcher. None of these devices would provide transport as secure as that which would be provided by an adjustable arm support attached to the side rail of a stretcher.

SUMMARY OF INVENTION—OBJECTS AND ADVANTAGES

It is the primary object of this invention to provide an arm support for attachment to a medical stretcher which would support the arm of a person sitting or lying in the stretcher in a fixed position during transport to a medical facility. It is also an object of this invention to provide an arm support for attachment to a medical stretcher which would be adjustable. A further object of this invention is to provide an arm support for attachment to a medical stretcher which would be able to elevate a patent's arm relative to the patient's body. It is also an object of this invention to provide an arm support for attachment to a medical stretcher which would attach to the side rails of the stretcher. A further object of this invention is to provide an arm support for a medical stretcher which would attach equally well to the right side and the left side of the stretcher.

As described herein, properly manufactured and attached to a medical stretcher, the present invention would provide fixed support for the arm of a person sitting or lying on the stretcher. Such fixed restraint of the arm would allow easier insertion of an intravenous device and also prevent further damage to the arm during transport. The arm support would attach to one of the side rails of the stretcher and attach equally well to the left and right sides of the stretcher. The arm support could also be folded against the side rail when not required for use. The elevation of the arm support, the rotation of its free end away from the side of the stretcher, and the angle at which a person's arm is supported would all be adjustable. Also, when the side rail to which the arm support is attached is lowered to a position 180 degrees from its usable position, the attached arm support would be placed in an out-of-the-way position beneath the stretcher. In the preferred embodiment of the present invention hook and pile fasteners would be used to secure a patient's arm to the arm support and allow quick release of the supported arm upon demand. Also in the preferred embodiment, a clamp, locking bolts, and a swivel unit would allow the present invention flexibility to assume many fixed positions for support of an arm or allow it to be folded in an out-of-the-way position when not needed for use. It is also possible to use the present invention to immobilize an arm independently from a stretcher and to attach it to other objects.

The description herein provides preferred embodiments of the present invention but should not be construed as limiting the scope of the arm support invention. Variations in the length of the arm support, the width of the arm support, the type of fasteners used to securely attach an arm to the arm support, the type of clamp used to attach the arm support to a stretcher, the type of swivel mechanism used, and the type of locking bolts used, other than those shown and described herein, can be incorporated into the present invention. Thus the scope of the present invention should be determined by the appended claims and their legal equivalents, rather than the examples given.

BRIEF DESCRIPTION OF THE DRAWINGS

FIG. 1 is a side view of the invention in a raised position and attached to a stretcher.

FIG. 2 is a side view of the invention in a lowered position and attached to a stretcher.

FIG. 4 is a side view of the invention in a raised position.

FIG. 5 is a side view of the invention in a lowered position.

FIG. 6 is a side view of the invention attached to the side rail of a stretcher which is in a raised position.

FIG. 7 is a side view of the invention attached to the side rail of a stretcher which is in a lowered position.

DETAILED DESCRIPTION OF PREFERRED EMBODIMENTS

Figure 3:
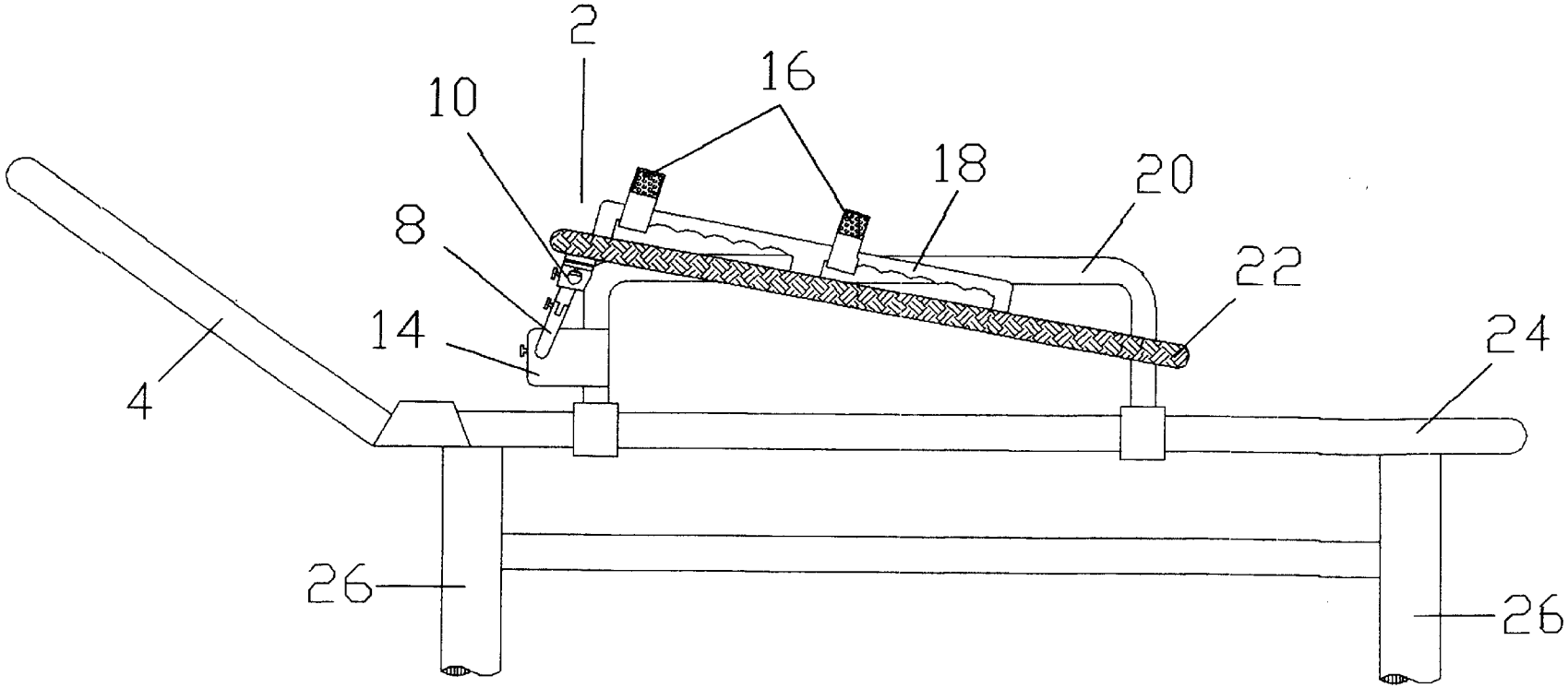
FIG. 3 is a side view of the invention in a raised position with locking bolts secured and attached to a stretcher

FIGS. 1, 2 and 3 show a preferred embodiment of a foldable arm support invention 2 for use with a medical stretcher having a main horizontal support 24, legs 26, a movable back support 4, and at least one side rail 20. FIGS. 1, 2, and 3 show foldable arm support invention 2 having a main support board 22, a side support 18 attached to the portion of main support board 22 used to support the upper part of an arm (not shown), two hook and pile fasteners 16 attached to side support 18, and a swivel unit 10 attached to a position on the underside surface of main support board 22 near to back support 4. FIGS. 1, 2, and 3 also show swivel unit 10 connected to one end of an elongated member 8, the other end of elongated member 8 being connected to a clamping unit 14 having locking bolts 12. In addition, FIGS. 1, 2, and 3 show a locking pin 6 for securing elongated member 8 in a fixed position. FIG. 1 shows foldable arm support invention 2 in a raised position and attached to side rail 20. FIG. 2 also shows foldable arm support invention 2 attached to side rail 20, but in a lowered position. FIG. 3 shows foldable arm support invention 2 attached to side rail 20 in a raised position and with locking bolts 12 in a secured position.

FIGS. 4 and 5 shows foldable arm support invention 2 attached to side rail 20 which is in a raised position relative to main horizontal support 24. FIGS. 4 and 5 also shows foldable arm support invention 2 having a main support board 22, side support 18 attached to main support board 22, fasteners 16 attached to side support 18, swivel 10, clamping device 14, locking bolts 12, elongated member 8 and locking pins 6 for securing swivel 10 in a fixed position, elongated member 8 to clamping device 14, and portions of elongated member 8 into a fixed position. FIG. 4 shows foldable arm support invention 2 in an elevated position with respect to side rail 20, while FIG. 5 shows foldable arm support invention 2 in a lowered position with respect to side rail 20.

FIGS. 6 and 7 show arm support invention 2 folded against side rail 20. In FIG. 6 side rail 20 is in a raised position, and in FIG. 7 side rail 20 is in a lowered position placing foldable arm support invention 2 into an out-of-the-way position beneath main horizontal support 24. FIGS. 6 and 7 also show the medical stretcher having main horizontal support 24, legs 26, movable back support 4, and at least one side rail 20. FIG. 6 also shows foldable arm support invention 2 having main support board 22, swivel 10, two locking pins 6, and elongated member 8, while FIG. 7 shows foldable arm support invention 2 having main support board 22, one locking pin 6, clamping device 14, two side supports 18, and fasteners 16 attached to side support 18.

Figure 9:
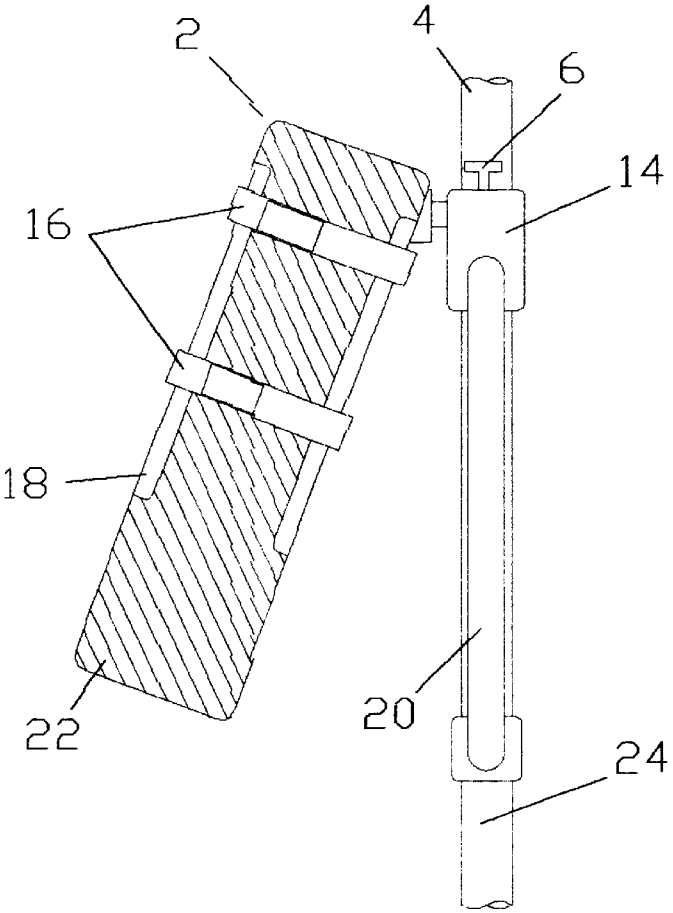
FIG. 9 is a top view of the invention.
Figure 8:
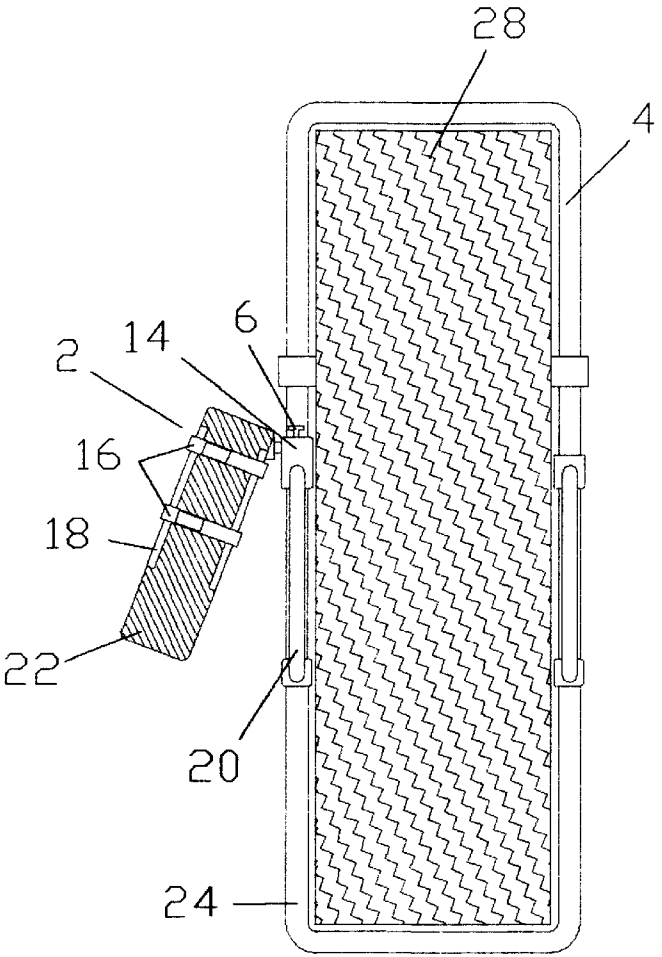
FIG. 8 is a top view of the invention attached to a stretcher.

FIG. 8 shows a medical stretcher having two side rails 20 and a mattress 28 positioned upon main horizontal support 24 and back support 4. FIGS. 8 and 9 show foldable arm support invention 2 attached by clamping device 14 to side rail 20. Locking pin 6 securely fixes clamping device 14 to side rail 20. FIGS. 8 and 9 show foldable arm support invention 2 in a non-parallel position with respect to mattress 28. FIGS. 8 and 9 also show foldable arm support invention 2 having a main support board 22, side supports 18 and fasteners 16 attached to side supports 18.

In the preferred embodiment it is contemplated for main support board 22 to be made of rigid materials which may be easily cleaned, or wrapped with a covering (not shown). In the preferred embodiment it is also contemplated for side supports 18 to be rigid. The material from which fasteners 16 are made are not critical to the present invention, however, they must be easy to open and close, open and close expediently, and be able to securely fasten an arm (not shown) into foldable arm support invention 2. In the preferred embodiment it is contemplated for fasteners 16 to comprise hook and pile type of fastening devices. Also, locking bolts 12 and locking pins 6 are not critical to the present invention. It is contemplated to have other securing devices which would perform the same functions as locking bolts 12 and locking pins 6.

To use foldable arm support invention 2, emergency medical personnel would attach clamping device 14 to side rail 20 of a medical stretcher with locking bolts 12. Foldable arm support invention 2 could be attached to side rail 20 when side rail 20 is in a raised or lowered position. Depending on the needed orientation of main support board 22, emergency medical personnel would adjust swivel 10 and elongated member 8 and then position locking pins 6 to secure swivel 10 and elongated member 8 into fixed positions. The arm of a person sitting or lying on main horizontal support 24 is securely attached to main support board by fasteners 16. When the person leaves main horizontal support 24, foldable arm support invention 2 may be detached from side rail 20 and moved with the person for continued support of the his or her arm. Subsequently, clamping device 14 may be used to attach foldable arm support invention 2 to other objects (not shown).

What is claimed is:

1. A stretcher and arm support combination comprising:

the stretcher having a main horizontal support portion, and at least one side rail connected to said main horizontal support portion, said at least one side rail being in a raised position relative to said main horizontal support portion for support of an arm of a person positioned on said main horizontal support portion of said stretcher; and the arm support including a main support board, two side supports laterally attached to said main support board, a plurality of fasteners, at least one of said fasteners attached to each of said side supports for securely positioning said arm against said main support board, clamping means for attaching said arm support to one of said side rails, an elongated member having two opposite ends, one of said opposite ends connected to said clamping means, at least one swivel unit connected to the other of said opposite ends, one of said swivel units also being connected to said main support board, and a plurality of locking devices to secure said swivels and said elongated member in fixed positions so that when said clamping means attaches said arm support to one of said side rails and when said fasteners secure said arm to said main support board, said swivel unit and said elongated member allow said arm support to move laterally, change pitch, and change height relative to said main horizontal support portion.

2. The combination of claim 1 wherein at least one of said fasteners comprises hook and pile fastening means.

3. The combination of claim 1 wherein said clamping means comprises a plurality of locking bolts.

4. The combination of claim 1 wherein said locking devices comprise a plurality of locking pins.

5. The combination of claim 1 wherein said main support board is foldable against one of said side rails.

* * * * *